US008177340B2

(12) United States Patent
Harazim

(10) Patent No.: US 8,177,340 B2
(45) Date of Patent: May 15, 2012

(54) DEVICE AND PROCESS FOR RETROFITTING A PRINTER

(75) Inventor: Eugen Harazim, Dortmund (DE)

(73) Assignee: Artech GmbH Design + Production In Plastic, Dortmund (DE)

( * ) Notice: Subject to any disclaimer, the term of this patent is extended or adjusted under 35 U.S.C. 154(b) by 1355 days.

(21) Appl. No.: 11/802,927

(22) Filed: May 25, 2007

(65) Prior Publication Data

US 2007/0279464 A1 Dec. 6, 2007

(30) Foreign Application Priority Data

Jun. 2, 2006 (DE) ..... 10 2006 026260
Jul. 31, 2006 (DE) ..... 10 2006 036716

(51) Int. Cl.
*B41J 2/175* (2006.01)

(52) U.S. Cl. ..... 347/86; 347/108

(58) Field of Classification Search ..... 347/18, 347/20, 49, 84, 85, 86, 87, 214; 399/91, 399/106, 107, 110, 111, 113, 262; 400/181, 400/202, 207, 208, 208.1, 679, 691, 693, 400/693.1

See application file for complete search history.

(56) References Cited

U.S. PATENT DOCUMENTS

| | | | | |
|---|---|---|---|---|
| 4,853,708 | A * | 8/1989 | Walters | 347/86 |
| 5,049,904 | A * | 9/1991 | Nakamura et al. | 347/19 |
| 5,127,750 | A * | 7/1992 | Burgin | 400/208 |
| 5,208,610 | A * | 5/1993 | Su et al. | 347/49 |
| 5,410,641 | A * | 4/1995 | Wakabayashi et al. | 358/1.13 |
| 5,519,422 | A * | 5/1996 | Thoman et al. | 347/49 |
| 5,530,531 | A * | 6/1996 | Girard | 399/120 |
| 5,764,260 | A * | 6/1998 | Vu et al. | 347/87 |
| 6,014,533 | A * | 1/2000 | Kawana | 399/90 |
| 6,030,075 | A * | 2/2000 | Swanson et al. | 347/87 |
| 6,155,678 | A * | 12/2000 | Komplin et al. | 347/86 |
| 6,161,920 | A * | 12/2000 | Santhanam et al. | 347/50 |
| 6,547,378 | B2 * | 4/2003 | Santhanam et al. | 347/86 |
| 6,655,785 | B1 * | 12/2003 | Hilton et al. | 347/49 |
| 6,796,646 | B2 * | 9/2004 | Komplin et al. | 347/86 |
| 6,929,155 | B1 * | 8/2005 | Sayers | 222/181.3 |
| 2001/0013884 | A1 * | 8/2001 | Crystal et al. | 347/85 |
| 2002/0094207 | A1 * | 7/2002 | Richards et al. | 399/8 |
| 2003/0035035 | A1 * | 2/2003 | Komplin et al. | 347/86 |
| 2005/0068409 | A1 * | 3/2005 | Igi et al. | 347/214 |
| 2005/0135838 | A1 * | 6/2005 | Miller | 399/120 |
| 2006/0012634 | A1 * | 1/2006 | Squie et al. | 347/49 |
| 2006/0153599 | A1 * | 7/2006 | Miller | 399/262 |
| 2006/0203045 | A1 * | 9/2006 | Kobayashi et al. | 347/84 |
| 2007/0264043 | A1 * | 11/2007 | Miller | 399/111 |

FOREIGN PATENT DOCUMENTS

| | | |
|---|---|---|
| EP | 440 261 B1 | 5/1994 |
| EP | 854 045 B1 | 9/2000 |

* cited by examiner

*Primary Examiner* — Mark Robinson
*Assistant Examiner* — Peter Radkowski
(74) *Attorney, Agent, or Firm* — Welsh Flaxman & Gitler LLC

(57) ABSTRACT

This invention relates to a device for retrofitting a printer which has a cartridge receiving device for holding interchangeable consumable material cartridges. In order to reduce the cost of production, transport and storage, the device has an insert which has fastening means for attachment in the cartridge receiving device of a printer, on the insert a locking means being made which blocks the fastening means in the fastening position when a consumable material insert cartridge is connected in the cartridge receiving device.

19 Claims, 19 Drawing Sheets

DEVICE AND PROCESS FOR RETROFITTING A PRINTER

BACKGROUND OF THE INVENTION

This invention relates to a device and a process for retrofitting a printer which has a cartridge receiving device for holding interchangeable consumable material cartridges.

The existing art discloses printers, especially inkjet printers, in a host of different embodiments. For supply with consumable material, generally interchangeable disposable consumable material receptacles, so-called consumable material cartridges are used, for example ink cartridges. These consumable material cartridges are inserted for operation into cartridge receiving devices in the printer. When such a cartridge is empty, it is removed from the cartridge receiving device, disposed of, and replaced by a filled cartridge.

Especially ink cartridges for ink supply of inkjet printers are common as such interchangeable disposable consumable material cartridges. Generally they have a housing which is made for attachment in the corresponding receiver of a printer. In the housing of the ink cartridge the actual ink reservoir is an individual or several ink receptacles which can be filled with various inks. Each ink receptacle has an ink outlet opening for detachable connection to the ink supply connection of the printer. In this way ink is supplied to the printer in operation. When the ink contained in the ink receptacle has been used up, the empty ink cartridge can simply be removed from the receiver, and replaced by a full ink cartridge. The empty ink cartridges are either disposed of or refilled with ink for re-use.

Generally different types of printers have differently made cartridge receiving devices, i.e. generally compartments or shafts into which the ink cartridges can be inserted. They differ especially in shape and dimensions and in fastening means with which the cartridges are fastened in the printer. In this way a printer can be operated only with the consumable material cartridges of the respective printer manufacturer for the respective printer type.

In addition, cartridges for different printer types also differ from one another by electronic and mechanical identifications and keys. In part this differentiation of consumable material takes place preferentially for the purpose of tying the user of the printer to the exclusive use of the consumable material of the respective printer manufacturer which is suited in each case.

In this way a correspondingly large number of different consumable material cartridges must be kept ready; this means high production costs and also entails a correspondingly high cost for transport and storage.

In view of the problems explained above in the existing art, it is an object of the invention to reduce costs for production, transport and storage.

SUMMARY OF THE INVENTION

To achieve this object, a device for retrofitting a printer has a cartridge receiving device for holding interchangeable consumable material cartridges, comprising an insert which has fastening means for fastening in a cartridge receiving device of the printer, on the insert a locking means provided which blocks or locks the fastening means in the fastening position when a consumable material cartridge is connected in the cartridge receiving device.

For the first time the invention makes it possible to retrofit printers, i.e. to modify them such that standardized consumable material insert cartridges, hereinafter also called insert cartridges for short, can be used for a host of different printer types. The printer is modified by simple attaching the insert as claimed in the invention in the cartridge receiving device of the printer. In this connection the insert is matched to the respective printer type by its having fastening means which can be connected like the original consumable material cartridges intended for this printer, for example ink cartridges, to the cartridge receiving device. Retrofitting can therefore be easily done by the printer user by attaching this insert.

One particular of the device is that the locking means is blocked in the fastening position when an insert cartridge is inserted onto the fastening means. In this way the insert cartridge cannot be removed together with the device as claimed in the invention and cannot be inserted together either.

In one advantageous development the insert has connecting means for connection of a consumable material insert cartridge, the locking means being actuated when an insert cartridge is connected, so that the insert can no longer be removed from the printer. The connection means in this regard are all those parts of the insert which contribute directly or indirectly to holding the insert cartridge in the retrofitted cartridge receiving device, therefore also support or contact surfaces which can come into contact with the insert cartridge. Alternatively to rigid internals, the connection means can also have movable or elastic connecting elements, for example movable catch levers or elastic wall sections.

After installing the insert in the printer, standardized consumable material insert cartridges can be used which correspond to the insert or corresponding connection means of the insert. By making available inserts which are designed for use in different printers only by correspondingly different fastening means, however have uniform connection means, for a host of printer types standard consumable material insert cartridges can be used which can be used with different inserts. In this way the users of the printer are for the first time enabled to retrofit their printers themselves so that consumable materials from alternative manufacturers, so-called compatible insert ink cartridges, can also be used. Moreover, for the compatible manufacturers there is the possibility of offering insert ink cartridges for used in printers which have been retrofitted in this way, which differ from the original products of the printer manufacturer, which can optionally be produced more favorably and which also do not violate the patent rights of the printer manufacturers. For the end consumer there is the advantage that economical, comparable ink cartridges can be used and dependency on the original consumable material of the printer manufacturer which is generally offered at inflated prices is eliminated.

Furthermore, retrofitting of a printer with a device is especially advantageous with regard to environmental protection aspects. While specifically most original ink cartridges of printer manufacturers are made with complex electronic protective circuits and semiconductor memory means which must be disposed of with an emptied disposable cartridge, a printer which has been retrofitted can be operated with simpler ink tanks which themselves are more environmentally friendly in disposable use. Due to the invention electronic scrap can be reduced and natural resources are saved.

One important feature of the insert is that it can be fastened in the cartridge receiving device or removed again only when a consumable material insert cartridge (ink cartridge) is not connected or inserted. Because there is a locking means, the fastening means of the insert are fixed specifically in the fastening position in the cartridge receiving device of the printer as long as an ink cartridge is inserted. In this way it is not possible either to attach the insert first to the cartridge and to insert them together into the printer. Conversely it is not possible to remove the insert cartridge together with the insert from the printer. While the insert cartridge is being removed, the insert remains in the printer. This is also a good idea since generally a new, filled insert cartridge is being inserted again.

The insert is therefore unequivocally part of the printer, and not of the ink cartridge. This has the advantage of simpler handling than in those systems as have been described for example in the prior art in EP 440 261 B1 or EP 854 045 B1. They relate simply to consumable material cartridges, for example ink cartridges, in which a consumable material receptacle, for example an ink tank, is interchangeable in a frame or carrier. This frame or carrier however must always be removed from the printer when the store of consumable material is to be replaced. Thus the frame or carrier is a part of the cartridge, not of the printer. This makes handling more complex. Moreover it happens that users erroneously dispose of the carrier or frame together with the empty ink receptacle. Consequently retrofitting of the printer in the sense of this invention with the associated advantages does not take place.

Preferably the fastening means on the insert comprise stationary holding elements. They can be for example projecting cams, pegs, projections or edges, but also molded openings, depressions, grooves or the like. They are adapted for fastening in the cartridge receiving device of a printer. The fastening means can also be made similarly, as on an original cartridge which is suited for the respective printer type; alternatively other fastening points in the cartridge receiving device of the printer can be used to fix the insert.

It is advantageous for the fastening means to comprise connecting means which can moved relative to the insert. They can be for example movable catch levers, elastic catches, movable locks or the like. They can be moved out of a fastening position into a release position. The insert can only be inserted into the printer or removed in the release position of this fastening means. In the fastening position the insert can be neither removed from the cartridge receiving device when it is installed in the printer, nor can it be fixed. The invention the release position for mounting or dismounting can only be set when the locking means of the insert is unlocked, i.e. only when an ink cartridge is not connected to the insert. The insert consequently always remains in the printer when an ink cartridge is being replaced. Accordingly the insert is not a component of the consumable material, but a functional part of the printer in the installed state.

Preferably the connecting means for connecting a cartridge to the insert comprise stationary holding elements, for example support elements which can be supported against a connected insert cartridge or a receiving shaft for one or more insert cartridges. It is furthermore possible for the connecting means to have projecting cams, edges, pegs or other projections, or also molded openings, grooves or other depressions. They can be matched to standardized insert cartridges.

The connecting means can also comprise joining means which can be moved relative to the insert, such as for example movable catch levers, elastic catches, movable locks or the like. Because joining means which can be moved in this way are actuated, i.e. moved when an insert cartridge is attached, they can be moved into the position in which they prevent actuation or movement of the actuating means of the insert, i.e. block it. In this way a locking means as claimed in the invention can be easily implemented.

Furthermore the insert can have electrical contact elements, for example contact pins, plugs, sockets, or also circuit boards with contact surfaces which are accessible from the outside and which correspond to mating contacts in the printer.

In one advantageous development the insert comprises data storage means, for example electronic, optical or mechanical storage elements. The data storage means can be connected to electrical contact elements which can be connected to the printer. In this way data can be stored and exchanged with the printer. Alternatively contactless data and energy transmission can take place, for example optically or electromagnetically, as in transponders or RFID (radio frequency identification devices).

It is furthermore advantageous for the insert to comprise electronic circuits, for example semiconductor elements, semiconductor memories, digital or analog components and modules. These electronic circuits are attached to the original cartridges by the printer manufacturer and are used to store the ink level and also as an electronic key for excluding non-original cartridges from use. One major disadvantage is that the disposable original ink cartridges of the printer manufacturers after use must be disposed of together with the electronic circuits. Conversely it is one advantage of the invention that the electronic circuits can be designed such that they can be continuously used. Thus electronic scrap can be reduced and an important contribution to environmental protection can be rendered.

Contactless or wireless data transmission elements can be attached to the insert, if the printer requires this type of data communication. These data transmission elements can be for example light emitting diodes (LED) in the visible or invisible (infrared/ultraviolet) spectral region which can be modulated for optical data transmission. For other forms of data transmission, antennas, acoustic transducers or the like can also be used. Preferably data transmission elements can be connected to an electronic circuit on the insert which can have data converters, modulators or the like.

Furthermore the insert can have sensor elements, for example electrical, optical, acoustic or other sensors. With the sensors for example the current ink level can be detected, as can other state variables which can be relevant to the printing process, for example temperature or the like. The sensors can be connected to an electronic circuit.

It is likewise conceivable for the insert to have display means. They can be for example optical or acoustic transducers which deliver warning or information signals which are perceptible to the user of the printer.

An insert can be made such that it can be attached in the individual cartridge receiving device of the printer which is made for holding the individual original ink cartridge with one or more ink tanks. Alternatively it can be made for attachment in several cartridge receiving devices. Regardless, the connecting means of an insert can be made for holding one single or also several insert cartridges. The corresponding configuration of the insert then makes it possible to replace an original ink cartridge by an insert ink cartridge or if it is an original multicolor cartridge, also by several individual insert ink cartridges.

It can furthermore be advantageous for the connecting means to have second electrical contact elements, for example contact pins, plugs, sockets or also circuit boards with contact surfaces which are accessible from the outside. The contact elements are arranged such that they come into contact with the inserted insert cartridge and correspond to the mating contacts on the insert cartridge.

An electronic circuit, for example a semiconductor memory means, which is connected to the mating contacts on the insert cartridge, can be attached to the insert cartridge. The mating contacts can be connected to the aforementioned second contact elements on the insert when the insert cartridge is inserted into the insert. The semiconductor memory means can be for example a simple, commercial memory module which is only readable (ROM—read only memory), writable once (write once memory/protected memory) or repeatedly rewritable (EEPROM=electrically erasable programmable ROM) in order for example to store ink-specific data such as color, original ink level and current level as well as other properties of the ink.

The second contact elements of the connecting means which can be connected to the insert cartridge are interconnected in the insert preferably with the aforementioned first contact elements which can be connected to the mating contacts in the printer. By an electrically conductive, electromagnetic or other connection, energy and/or data signals can be exchanged between the mating contacts in the printer via the insert with an electrical circuit, i.e. memory means or the like, on the insert cartridge. Between the first and second contact elements in the insert there can be an electronic circuit, for example a data conversion circuit which converts the complex data exchange protocol of the printer into a simpler protocol so that simple, economical memory modules can be used on the insert cartridge.

The printer can be an inkjet printing means, the consumable material insert cartridge being an ink cartridge.

The process for operating a printer which has a cartridge receiving device for holding interchangeable consumable material cartridges comprises the following process steps:

- insertion and fastening of an insert in the cartridge receiving device,
- connection of a consumable material insert cartridge, the insert being locked in the fastening position in the cartridge receiving device.

Before installation, i.e. when the insert is still outside the printer, first the fastening means are moved into the release position. In this way the insert can be inserted into the cartridge receiving device—conventionally a type of shaft or compartment—and the fastening means in the released position can be moved past the corresponding holding means (abutments, projections, openings, etc.) without intervention. In the end position the fastening means are moved into the fastening position, their engaging or interlocking with the corresponding holding means and in this way the insert is fixed in the cartridge receiving device of the printer.

After installation the insert remains for the time being in the printer. In this way it becomes essentially a component of the printer.

In the next step an insert cartridge is prepared and if movable connecting means are made on this insert cartridge and/or on the insert, these connecting means are moved into the release position. Then the insert cartridge is connected to the insert which is located in the cartridge receiving device. To do this the corresponding connection means are connected to one another.

The insert cartridge and the insert are made such that the fastening means which fix the insert in the cartridge receiving device are blocked or locked in this fastening position. This means that the fastening means cannot be released as long as an insert cartridge is connected to the insert. Accordingly the insert cannot be removed from the printer when the insert cartridge has been inserted.

Because the corresponding connection means are released and the cartridge is removed in the opposite direction of motion compared to insertion, the insert 11 can be easily replaced. The insert can remain in the printer so that as described a new, ink-filled insert cartridge can be inserted.

Only when a connected consumable material insert cartridge is separated from the insert can the insert be unlocked and then optionally removed from the cartridge receiving device, for example when an original ink cartridge of the printer manufacturer is to be used transitionally.

BRIEF DESCRIPTION OF THE DRAWINGS

Embodiments of the invention are detailed below using the drawings.

DETAILED DESCRIPTION OF THE INVENTION

Figure 1:
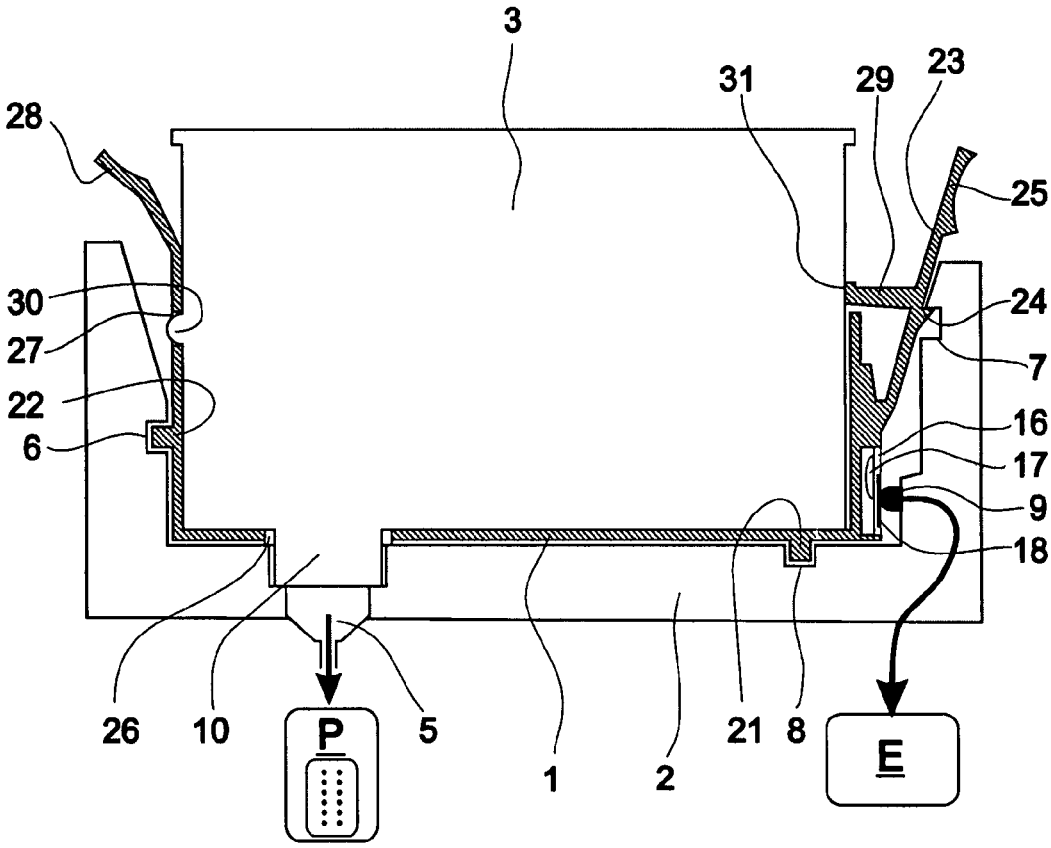
FIG. 1 shows a device in a first version installed in a printer.

FIG. 1 shows a fundamental arrangement of a device in the form of an insert 1 which is installed in a cartridge receiving device 2 of a printer which is not shown in particular (inkjet printer). The insert ink cartridge (3) (insert cartridge) is connected to the insert 1.

To explain the invention first the existing art is described below using the drawings in FIG. 2 and FIG. 3.

Figure 2:
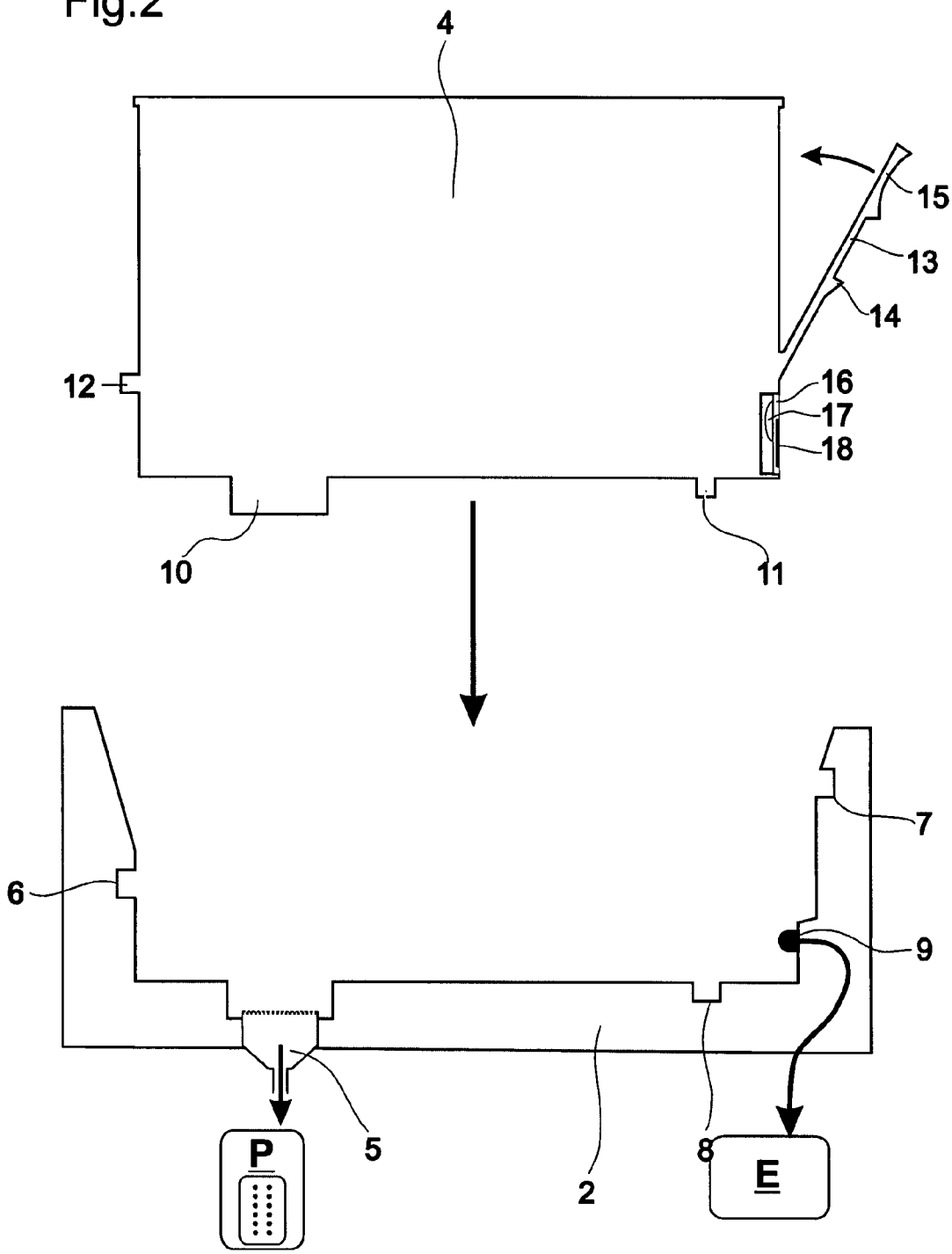
FIG. 2 shows the ink cartridge according the existing art before insertion into the cartridge receiving device of a printer.

FIG. 2 shows the same cartridge receiving device 2 of a printer as in FIG. 1 and in the drawing at the top an original ink cartridge 4 of the printer manufacturer in the uninstalled state. FIG. 3 shows the installed state, the same reference numbers being used.

The cartridge receiving device 2 has essentially the shape of a compartment or box which is open at the top; accordingly the insert opening is made at the top. On the bottom is the ink connection 5 which is connected in the printer to an inkjet printing head P which is schematically suggested. In the walls and on the bottom there are cartridge holding devices 6, 7, and 8 which in this example are made as recesses or openings, but can likewise comprise holding projections or edges. First electrical contact springs 9 project from the wall (right one in this drawings) into the receiving space of the cartridge receiving device 2 and are connected to a schematically suggested electronic circuit E of the inkjet printer.

The original ink cartridge 4 which is shown in FIG. 2 above the cartridge receiving device 2 is essentially an ink-filled, generally box-shaped receptacle in which ink can be located freely flowing in a sponge-like porous body or in a bag. This original ink cartridge 4 on the bottom has an ink outlet 10 and a fastening means in the form of a rigid peg 11. Another fastening means in the form of a laterally protruding projection 12 is formed on the front side wall, that is, on the left in the drawings. On the opposite side wall (on the right in the drawings) as another fastening means there is a catch lever 13 which is attached on its lower end to the wall and which consists of elastic plastic. On its outside there is a locking catch 14. If pressure is applied from the outside to the grip 15 molded onto its free end, the catch lever 13, as indicated with the arrow, is bent elastically resiliently in the direction against the wall.

Underneath the catch lever 14 a circuit board 16 is attached which on the back bears a semiconductor memory means 17 which is electrically connected to the contact surfaces or contact pads 16 on the front of the board 16. The circuit board 16 is attached countersunk so that the contact pads 18 lie essentially flush in the wall surface. Moreover the semiconductor memory means 17 is housed protected.

Figure 3:
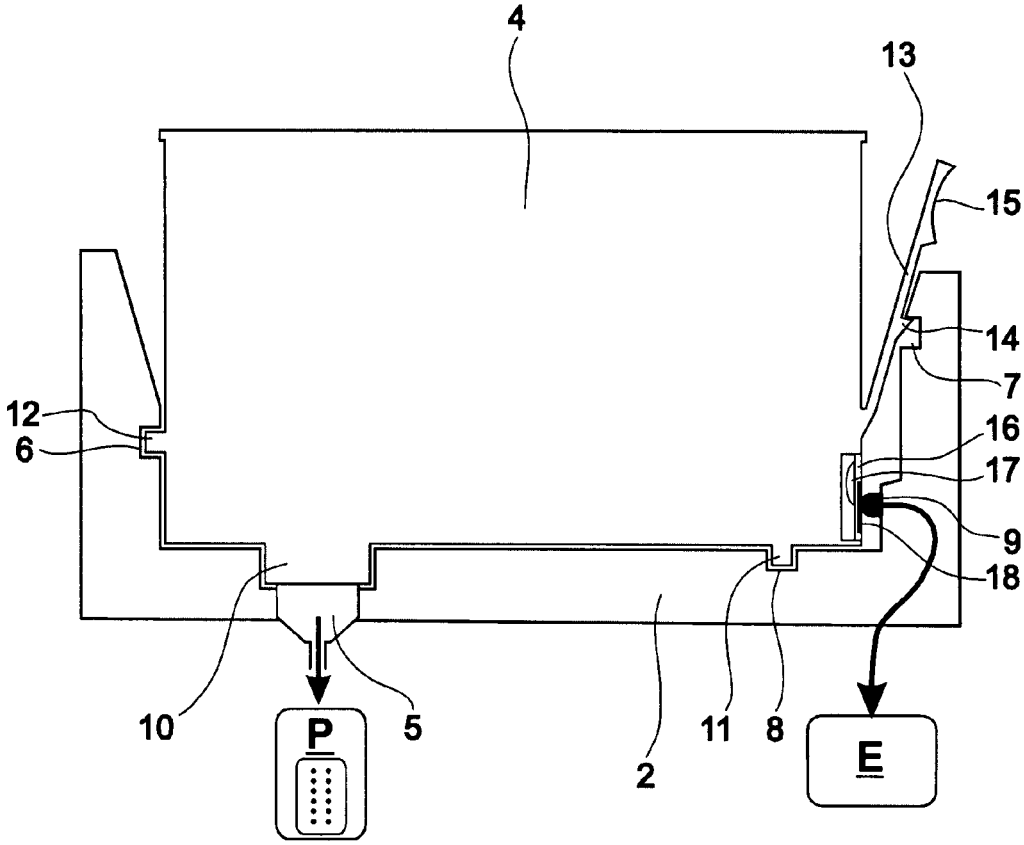
FIG. 3 shows an ink cartridge as shown in FIG. 1 in the inserted state.

If the original ink cartridge 4 is inserted into the cartridge receiving device 2 in the direction of the arrow which is pointed down in FIG. 2, the inserted state as shown in FIG. 3 results. In this connection the peg 11 and the projection 12 engage the corresponding notches 8 and 6 respectively in the cartridge receiving device 2. The locking catch 14 which is made on the catch lever 13 elastically snaps into the notch 7 so that it assumes its fastening position as shown in FIG. 2. In this state the ink outlet 10 is coupled to the ink connection 5 so that the printing head P is supplied with the ink contained in the original ink cartridge 4.

At the same time the contact springs 9 rest electrically conductively against the contact pads 18 so that the electronics E of the printer can electronically exchange data with the semiconductor memory means 17, for example information about the contents of the original ink cartridge 4, the current level or ink-related information.

Figure 4:
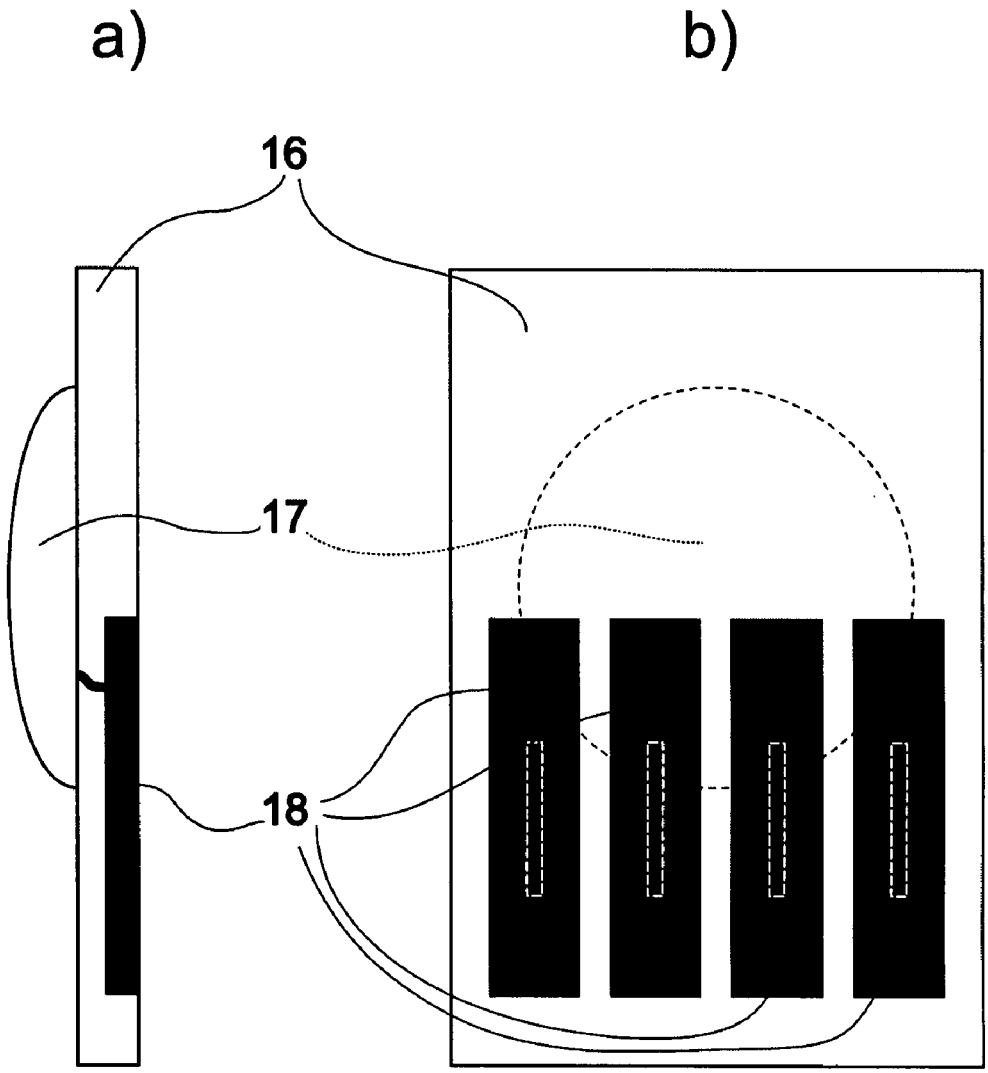
FIG. 4 shows a detailed view of a semiconductor memory means as shown in FIG. 1 and FIG. 3.

The circuit board 16 is shown enlarged in FIG. 4. In this connection on the contact pads 18 the region where the contact springs 9 adjoin is show in white by the broken line.

The operation and handling of the insert 1 as claimed in the invention as shown in FIG. 1 is reproduced in FIGS. 5*a* to 5*g* in several individual phases.

Figure 5A:
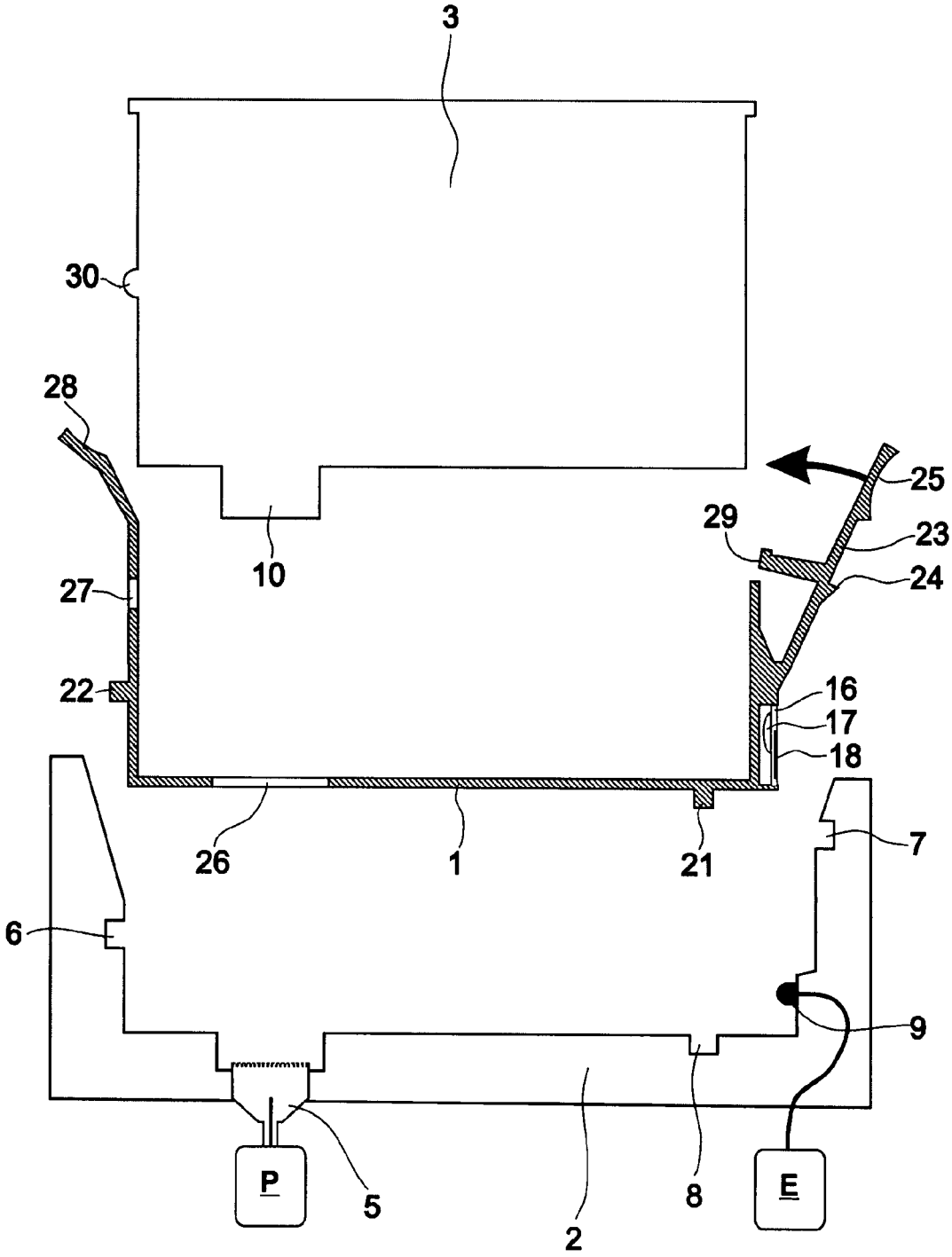
FIG. 5*a* shows an insert cartridge, an insert and a cartridge receiving device as shown in FIG. 1 before installation (=in the first installation phase)

FIG. 5*a* shows the cartridge receiving device 2 and above it the insert 1 and the insert cartridge 3 each in a separate state before installation (installation phase 1).

The insert 1 is made in principle like a U-shaped frame which has the outer dimensions of the original ink cartridge 4 and comprises an installation space open to the top for the insert cartridge 3. It likewise has fastening means which are made as a peg 21 underneath, a projection 22 forward, a catch lever 23 with a locking catch 24 and a grip 25 and correspond directly to the fastening means 11, 12, 13, 14 and 15 on the original cartridge 4 as shown in FIG. 2 and FIG. 3. In the region above the ink connection 5 of the cartridge receiving device 2 there is a through opening 26 in the bottom of the insert 1. The front section, i.e. the vertical leg of the insert 1 which is the left leg in the drawings, is made as a connecting means and above the projection 22 has a locking opening 27. A grip 28 is molded on the free end of the indicated leg.

On the part of the insert which is the right part in the drawings, a semiconductor memory means 17 together with the circuit board 16 with contact pads 18 is attached at the same position as on the original ink cartridge (4 in FIG. 1).

On the inside of the catch lever 23 a locking peg 29 is formed with action as claimed in the invention in the sense of a locking means which will be explained below.

The insert cartridge 3 is made as an ink receptacle similarly to the original cartridge 4 and like it has an ink connection 5. The connection means however, differently from the fastening means of the original ink cartridge 4, is a catch cam 30 which projects from the front wall (on the left in the drawings) to the outside.

Figure 5B:
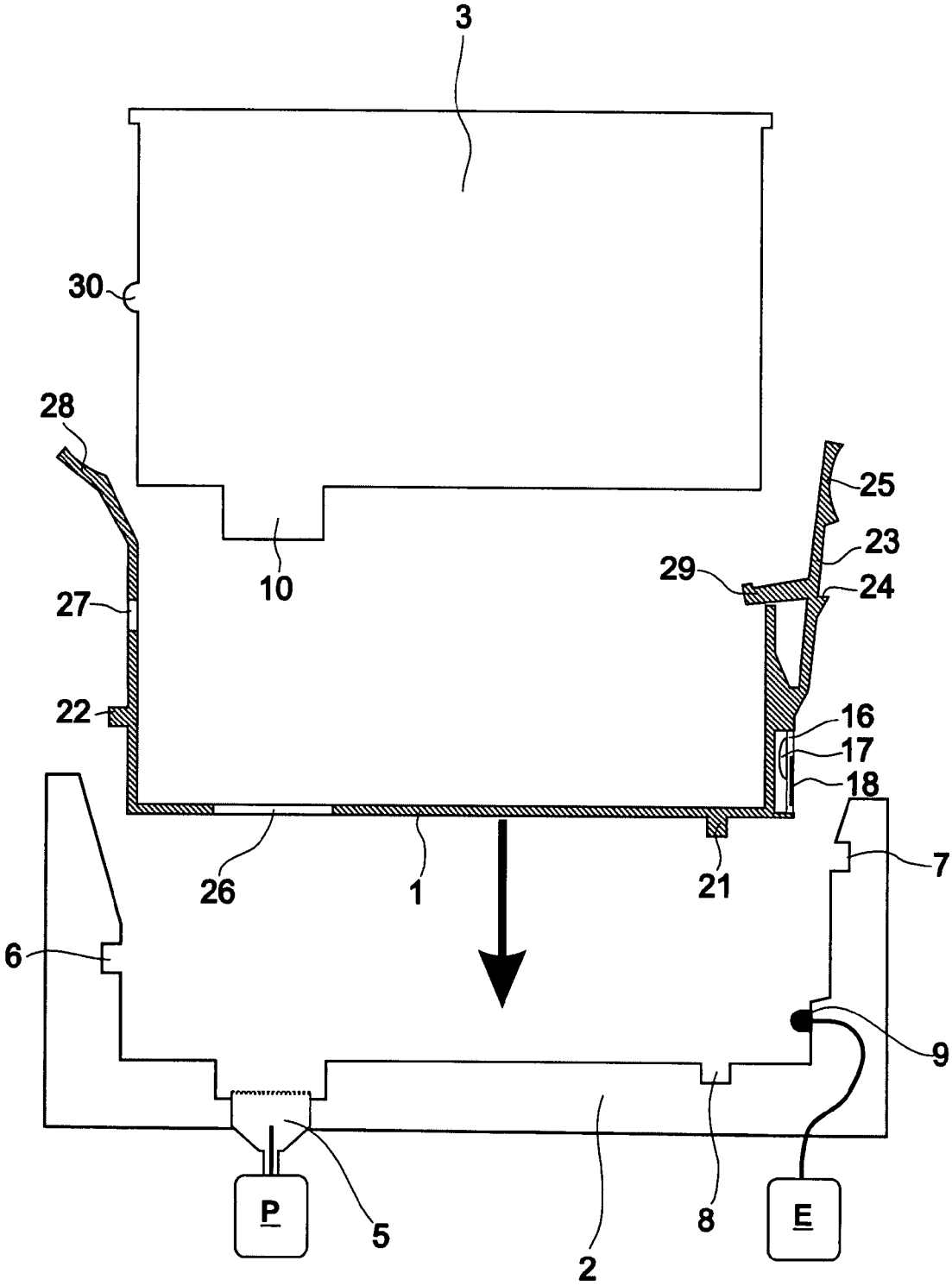
FIG. 5*b* shows the function elements as shown in FIG. 5*a* in the second installation phase.

In the first installation phase as shown in FIG. 5*a*, pressure is applied from the outside to the grip 25 of the catch lever 24, generally by hand with one finger so that the catch lever 24 is bent in the direction of the curved arrow to the inside until is assumes the release position shown in FIG. 5*b*.

In the 2nd installation phase as shown in FIG. 5*b* the locking catch 14 in the release position of the catch lever 13 is so near the rear (right) wall that the insert 1 can be inserted down into the cartridge receiving device 2 in the direction of the arrow pointed vertically down, the locking catch 14 remaining free, i.e. not engaging the notch 7.

Figure 5C:
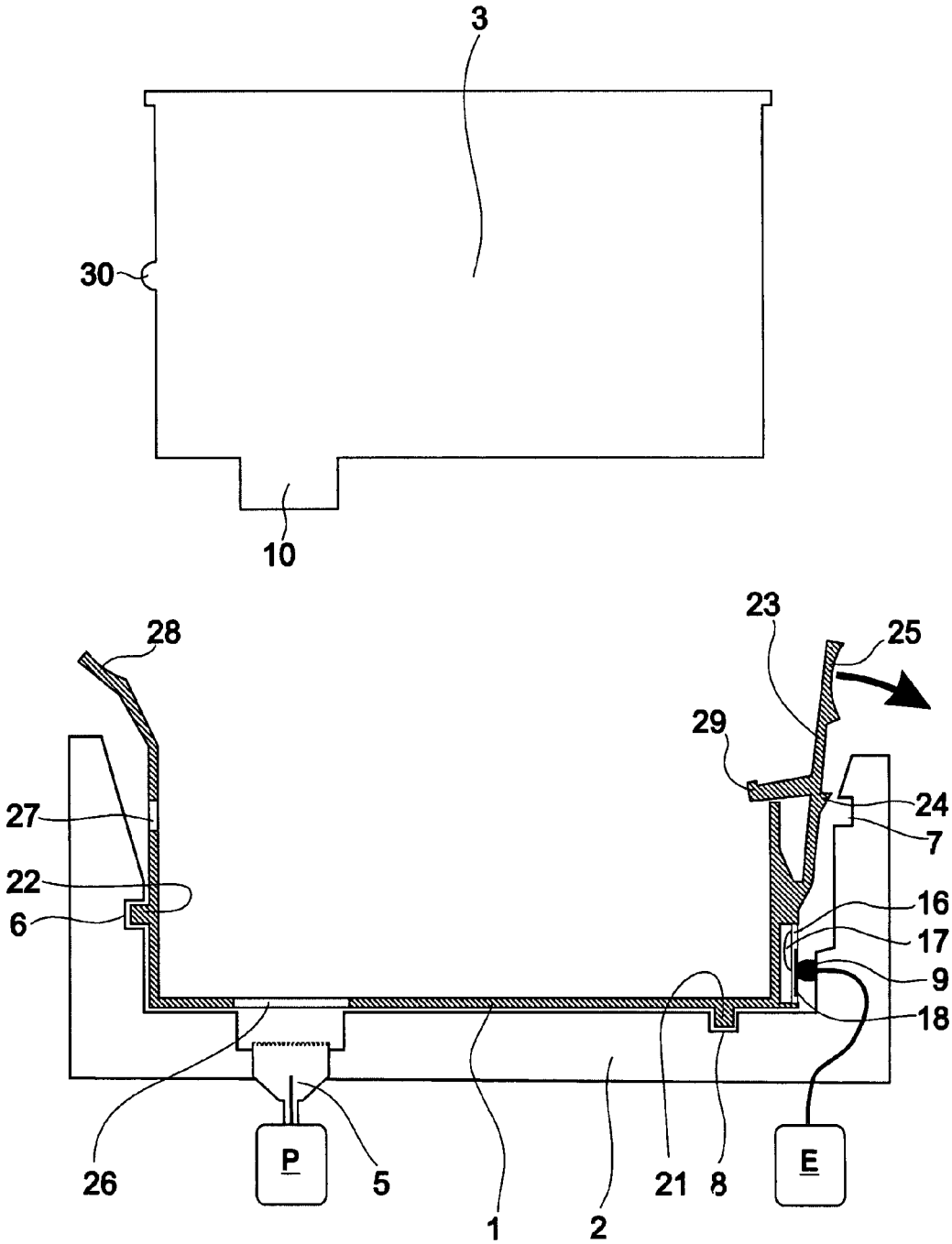
FIG. 5*c* shows the function elements as shown in FIG. 5*b* in the third installation phase.
Figure 5D:
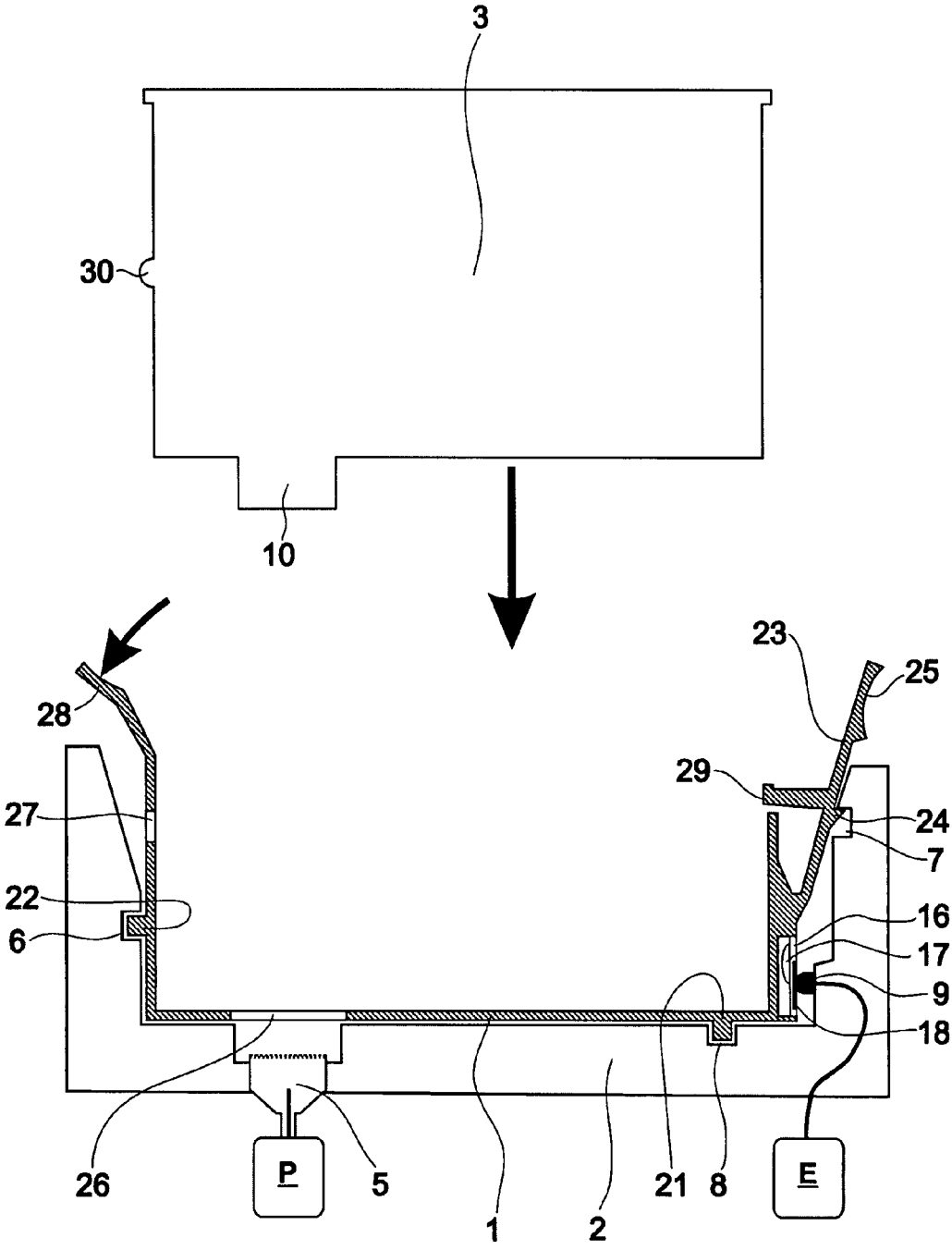
FIG. 5*d* shows the function elements as shown in FIG. 5*c* in the fourth installation phase.

Upon insertion, the insert 1 is lowered until it rests with its lower side on the bottom of the cartridge receiving device 2, as is shown in the 3rd installation phase in FIG. 5*c*. In this position the projection 22 of the insert 1 engages the notch 6 of the cartridge receiving device 2 and the peg 21 engages the recess 8 in the bottom. When released, the catch lever 13 is relieved spring-elastically to the outside; this is indicated with the bent arrow. In this connection the locking catch 13 assumes the fastening position and then engages the recess 7 as is shown in FIG. 5*d*. The contact pads 18 touch the contact springs 9 so that between the semiconductor storage means 17 and the printer electronics E an electrically conductive connection is produced which is used for power supply and for data exchange. Furthermore the through opening 26 from overhead leaves access to the ink connection 5 open.

In the 4th installation phase as shown in FIG. 5*d*, the insert 1 is installed ready for operation in the cartridge receiving device 2. Here the locking catch 13 is in the fastening position, i.e. fixes the insert 1. Then the insert cartridge, as indicated with the arrow pointed vertically down, can be inserted into the insert 1 from the top. In doing so the projecting catch cam 30 presses the free end with the grip 28 to the outside; this is indicated with the bent arrow.

Figure 5E:
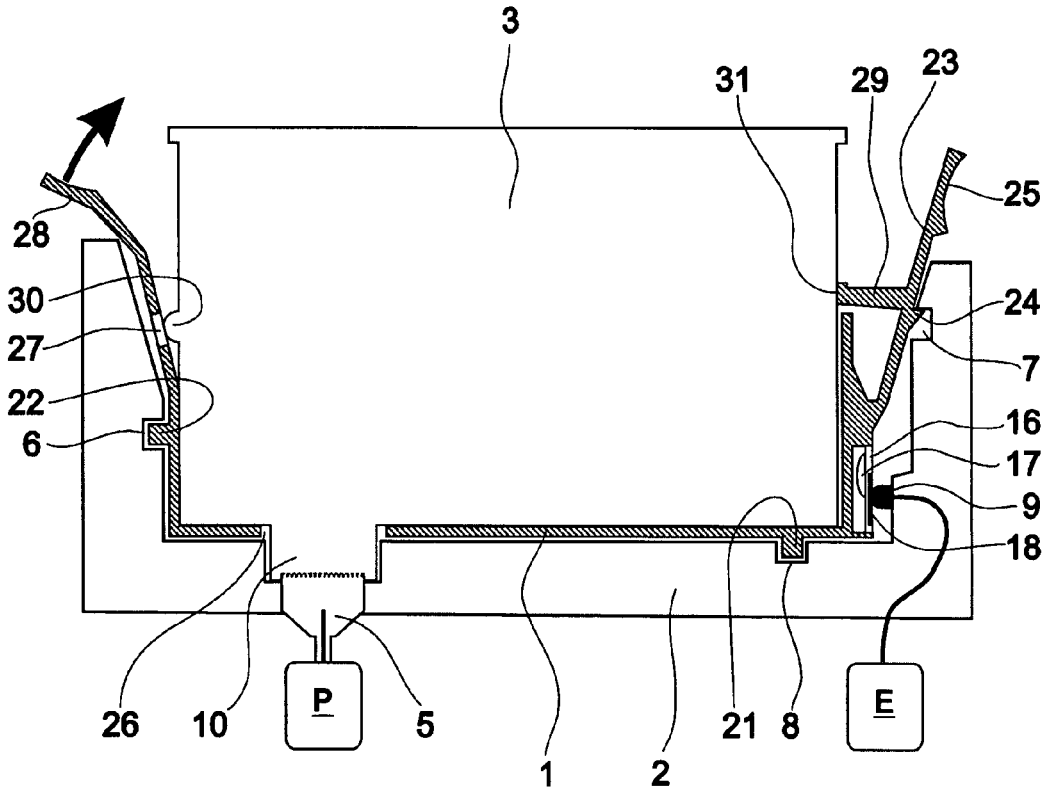
FIG. 5*e* shows the function elements as shown in FIG. 5*d* in the fifth installation phase.

In the 5th installation phase as shown in FIG. 5*e*, the insert cartridge 3 rests on the bottom of the insert 1, the ink outlet 10 projecting through the through opening 26 and being connected to the ink connection 5 so that the ink located in the insert cartridge 3 can be delivered to the printing head P. Due to its elasticity the (left) grip 28 snaps back in the direction of the arrow, the catch cam 30 engaging the locking opening 27.

Figure 5F:
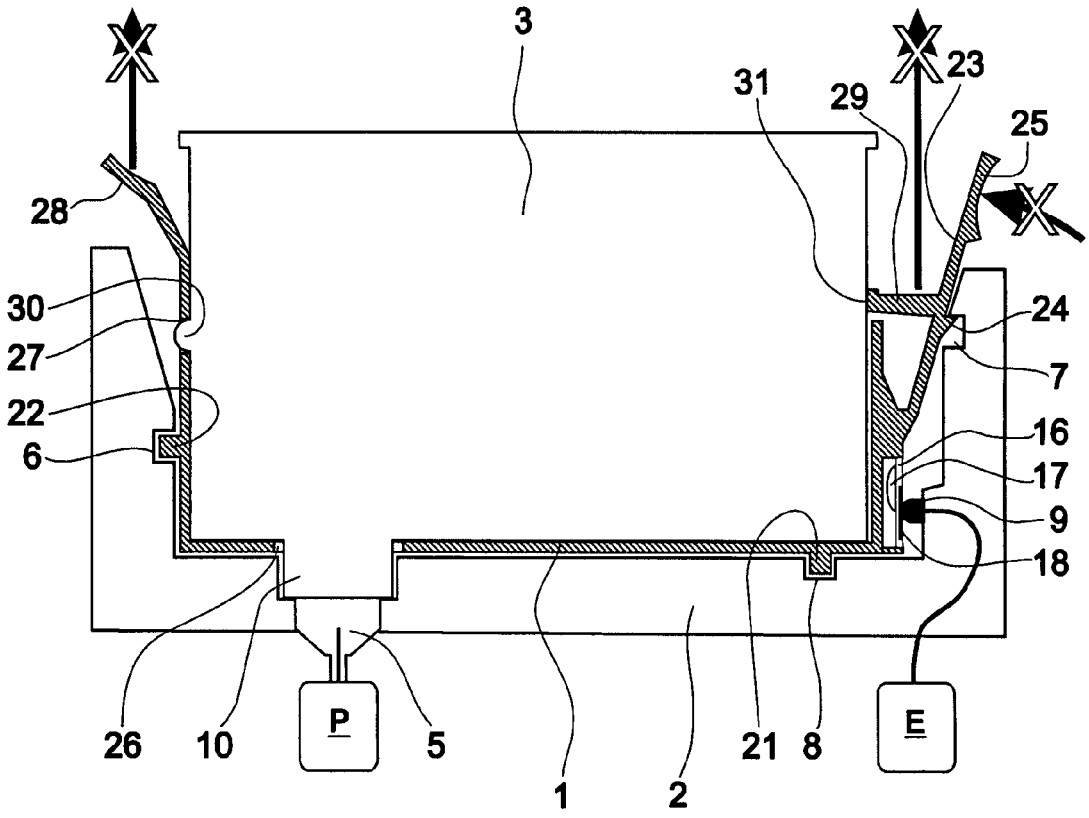
FIG. 5*f* shows the function elements as shown in FIG. 5*e* in the sixth installation phase (after installation=in the installed state)

Thus, in the 6th installation phase the operating position is reached which is shown in FIG. 5*f*. In this connection the recognizable particular feature as claimed in the invention is that the locking peg 29 in the support region 31 adjoins the wall of the insert cartridge 3 outside. In this way the catch lever 23 cannot be moved from the outside to the inside; this is indicated by the slashed arrow on the grip 25. In this way the catch lever 23 cannot be moved into the release position as long as the insert cartridge 3 is located in the insert 1. The locking peg 29 consequently forms a locking means which blocks the catch lever 23 which is used as a fastening means in the fastening position. Accordingly the insert 1 is locked and cannot be removed from the cartridge receiving device 2; this is illustrated with the slashed arrows pointed up.

Figure 5G:
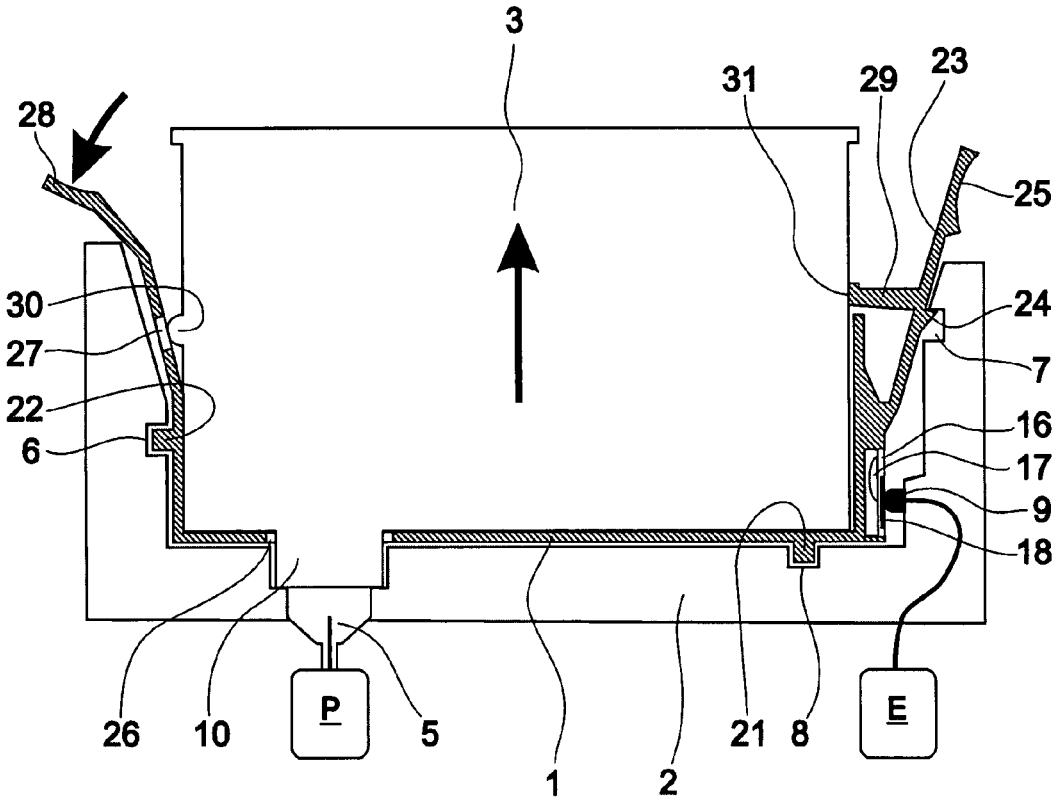
FIG. 5*g* shows the function elements as shown in FIG. 5*f* and FIG. 1 before dismounting.

FIG. 5*g* shows how the region with the locking opening 27 is bent to the outside by pressing on the grip 28 from the top such that the catch cam 30 is released and the insert cartridge 3 is released and can be removed up in the direction of the arrow for replacement.

Then a filled insert cartridge 3 can be inserted, as has been explained using FIG. 5*d* to FIG. 5*f*. The insert 1 remains as part of the printer in the cartridge receiving device 2. But if at a later time again original ink cartridges 4 are to be used, the insert 1 can be removed again by the installation phases according to FIGS. 5*c, b* and *a* being undertaken in the reverse sequence and in the reverse direction as in retrofitting.

Figure 6:
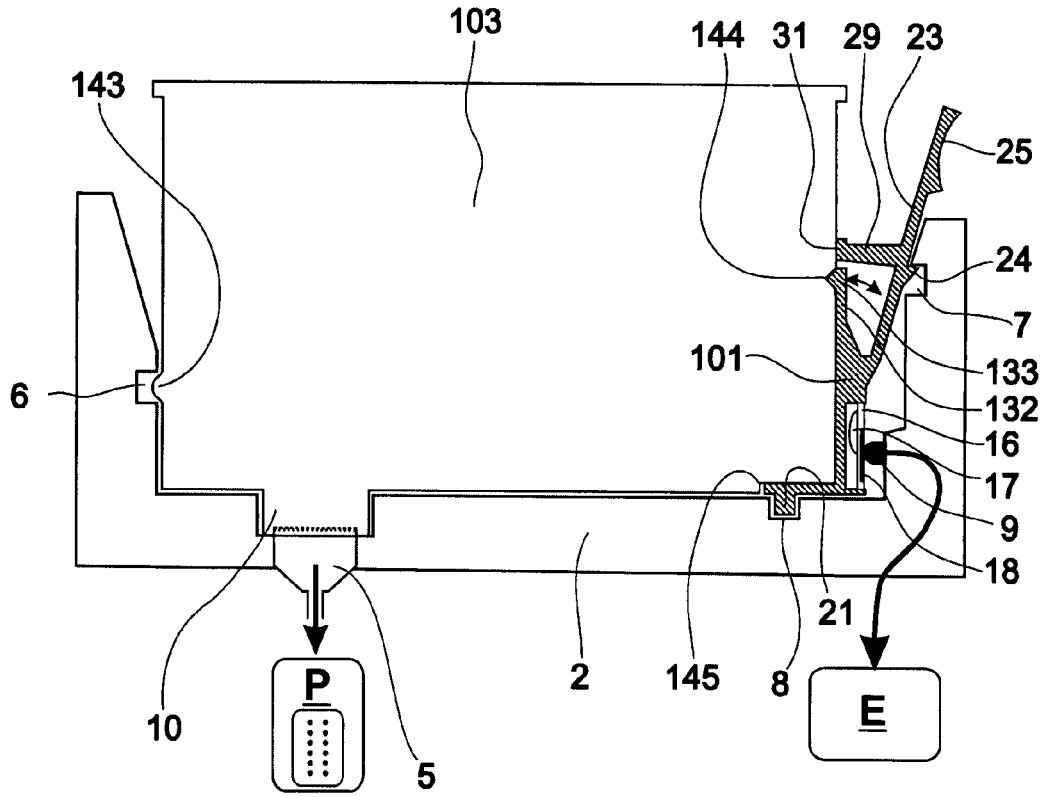
FIG. 6 shows the device as claimed in the invention in a second embodiment.
Figure 7:
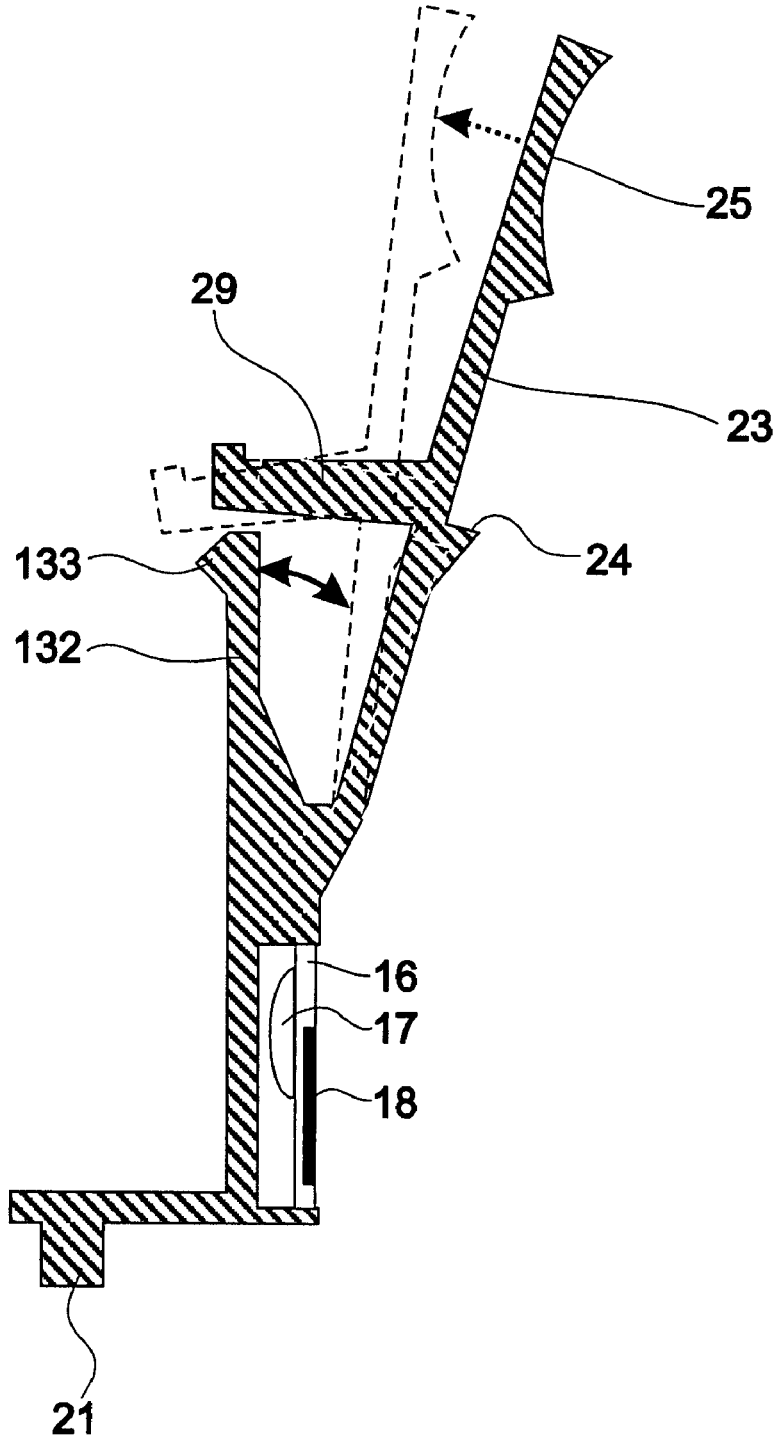
FIG. 7 shows the insert as shown in FIG. 6 in an enlargement.

FIG. 6 shows in the same view as FIG. 1 an insert in a second embodiment which is provided with reference number 101 and is shown enlarged in FIG. 7. For elements with the same action the same reference numbers as in FIG. 1 are used.

The insert 101 in contrast to the first embodiment (1) is fixed simply with the peg 21 and the locking catch 24 in the recesses 8 and 7 of the cartridge receiving device 2. Underneath the locking peg 29 an arm 132 is attached which can be moved elastically; this in indicated with the double arrow. On its elastically movable free end a catch projection 133 which projects to the inside is made.

The insert cartridge 103 is matched to use with the insert 101. With a projection 143 it directly engages the recess 6 of the cartridge receiving device 2. On the back which adjoins the insert 101, it has a depression 144. Upon insertion the catch projection 133 snaps into this depression 144 and fixes the insert cartridge 103 in the cartridge receiving device 2. The bottom of the insert cartridge 103 is provided with a step 145 so that the rear (right in the drawing) region rests on the insert 101 and the front part (left) directly on the bottom of the cartridge receiving device 2.

The enlarged view in FIG. 7 shows how the catch lever 23 can be moved out of the middle fastening position shown by the solid line to the inside into the release position shown by the broken line. Since the locking peg 29 then projects over the arm 132, the catch lever 23 can only be moved into the release position when an insert cartridge 103 has not been inserted.

The locking means works as in the first embodiment (1) shown in FIG. 1 and FIGS. 5*a* to 5*g*.

Figure 8:
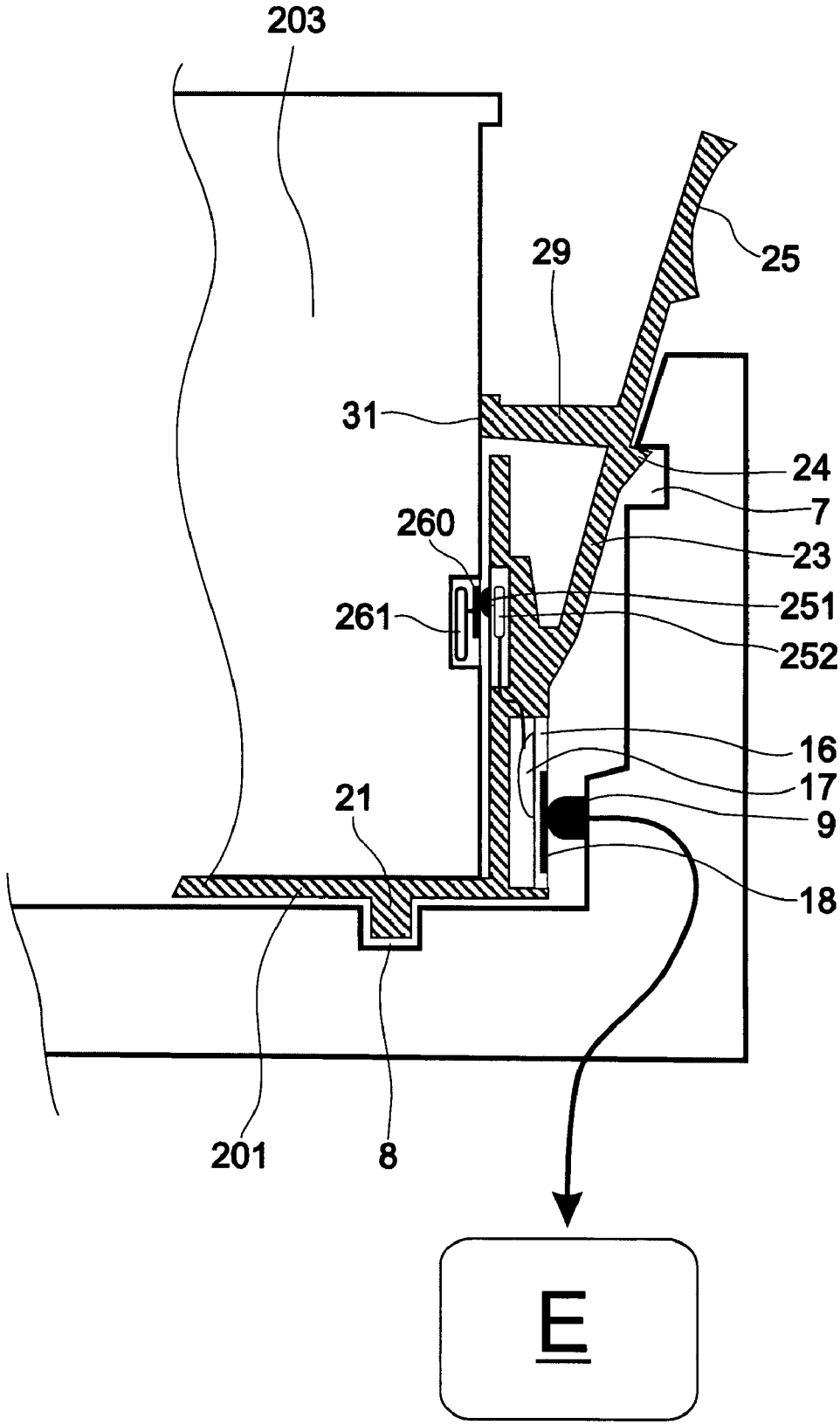
FIG. 8 shows the device as claimed in the invention in a third embodiment.

FIG. 8 shows a third embodiment of an insert 201. It is made essentially like the second version (101). In addition it has contact springs 251 which project on the inside and which are connected to an electronic circuit 252. The circuit 252 can be for example a code converter which is connected in the insert to the semiconductor memory means 17. The two circuits 17 and 252 can also be combined in one component or module which lies electrically between the contacts pads 18 and the contact springs 251.

The insert cartridge 203 is built fundamentally the same as the second version (103). In addition it has contact pads 260 which are connected to an electronic circuit 261, for example a semiconductor memory (EEPROM or the like) of simple design for storage of the ink level. In the inserted state the contact springs 251 of the insert 201 make contact with the contact pads 260 on the insert cartridge 203 and enable transmission of current and data.

Figure 9:
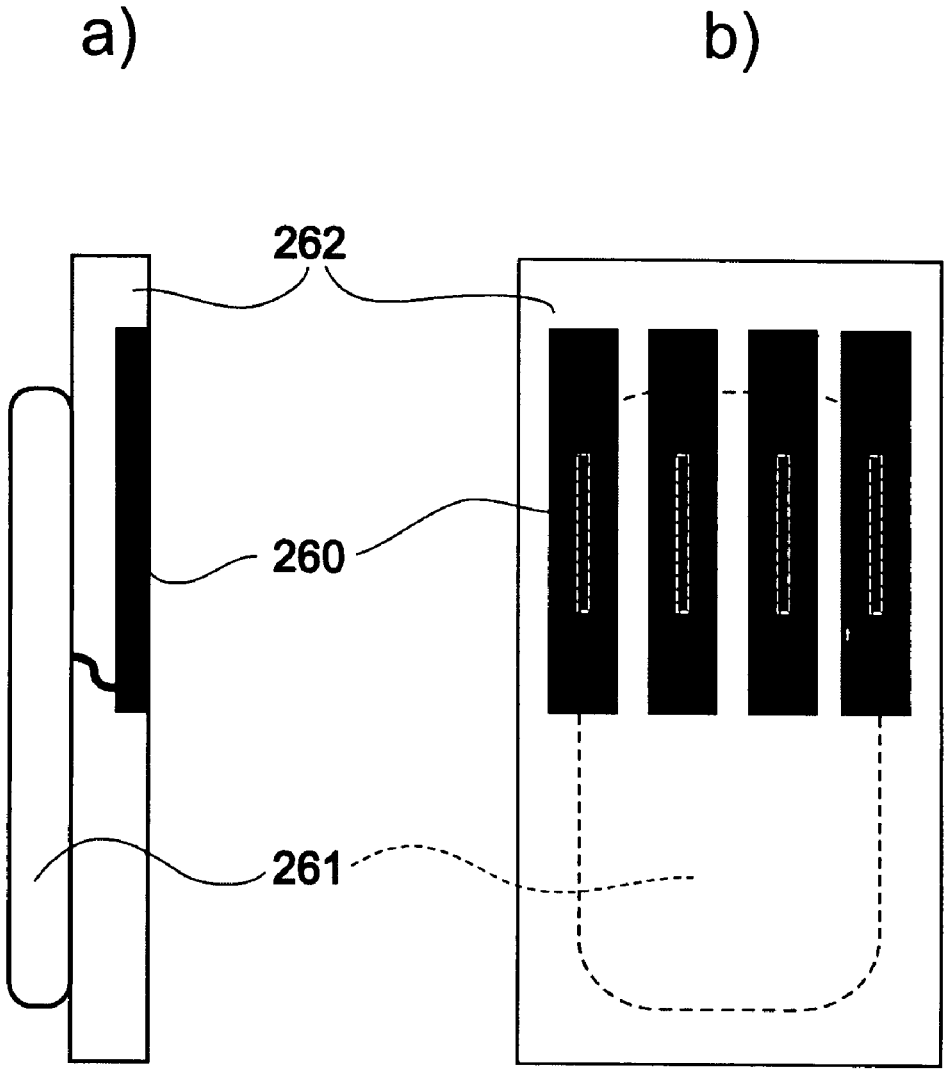
FIG. 9 shows a detailed view of the semiconductor memory means as shown in FIG. 8.

FIG. 9 shows the electronic circuit 261 enlarged, a) in a side view as in FIG. 8 and b) in a front view from the back. Installation on a circuit board 262 like circuit board 16 in FIG. 4 results therefrom.

Figure 10:
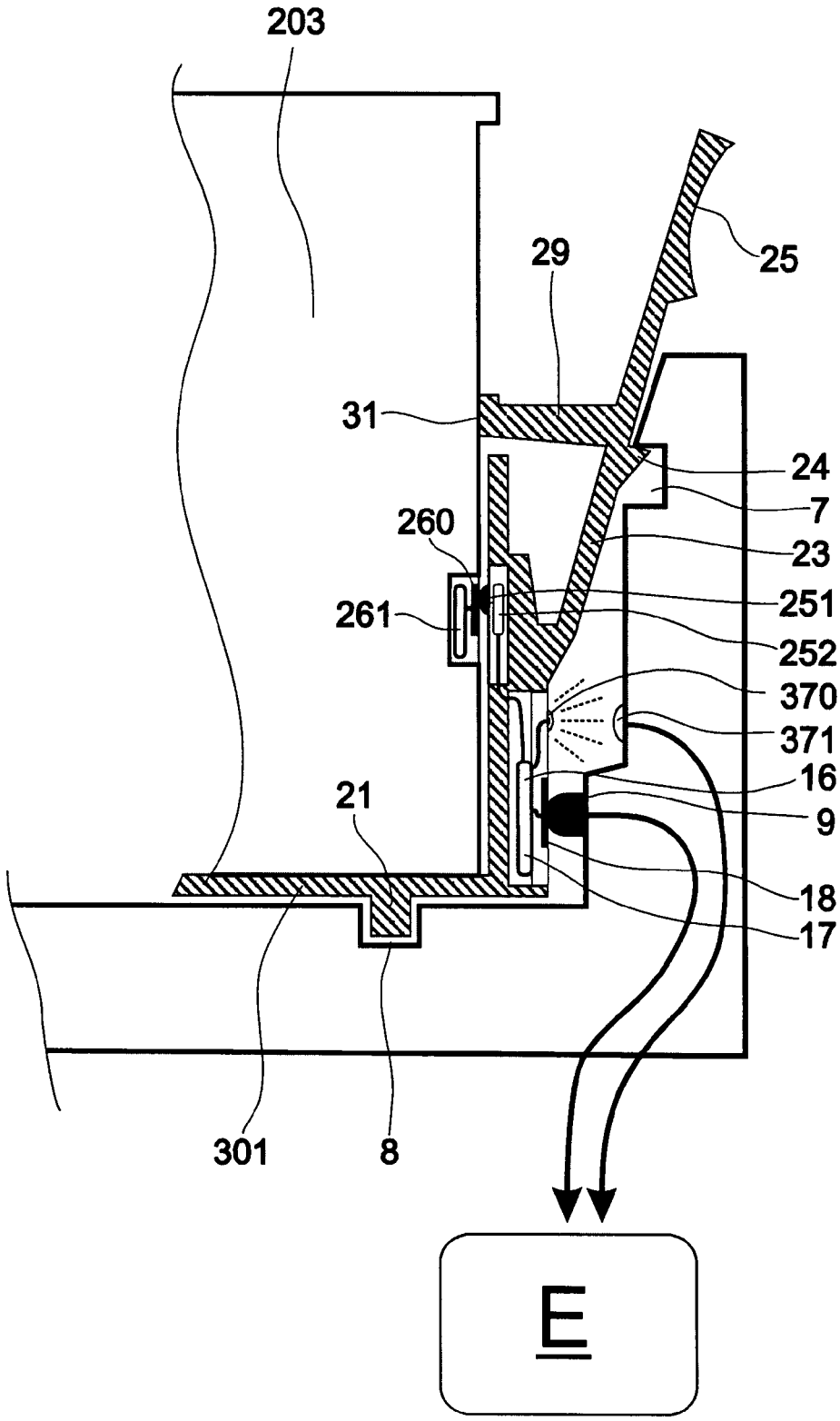
FIG. 10 shows the device as claimed in the invention in a fourth embodiment.

The fourth version of an insert 310 shown in FIG. 10 in addition to the above described version 201 has a transducer or contactless data transmission means 370 which can be connected to the electronic circuit 252 and 17. The transducer 370 can be an optical transmitter, for example a light emitting diode. In range of the transducer 370 the cartridge receiving device 2 has a receiver 371, for example an optical sensor which is connected in the printer to its electronics E.

Figure 11:
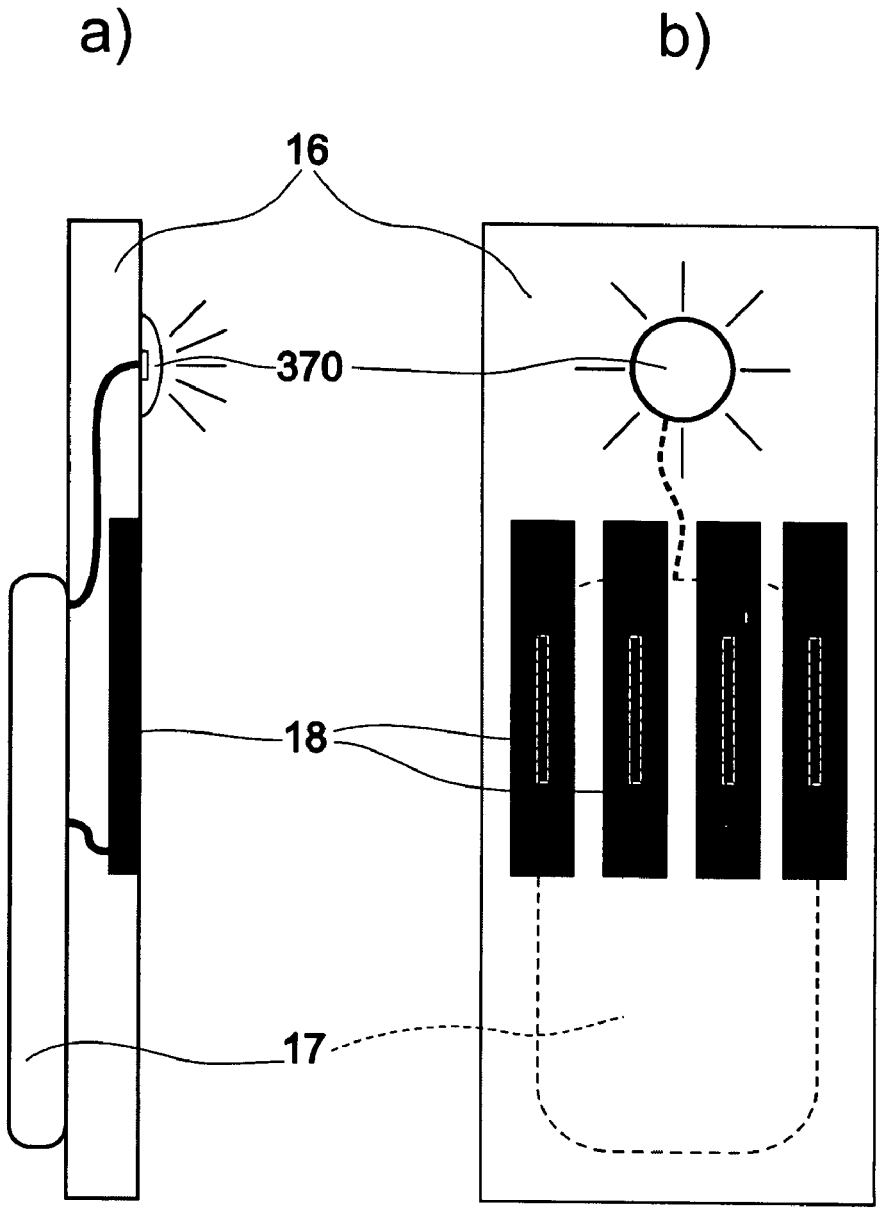
FIG. 11 shows a detailed view of the semiconductor storage means as shown in FIG. 10.
Figure 12:
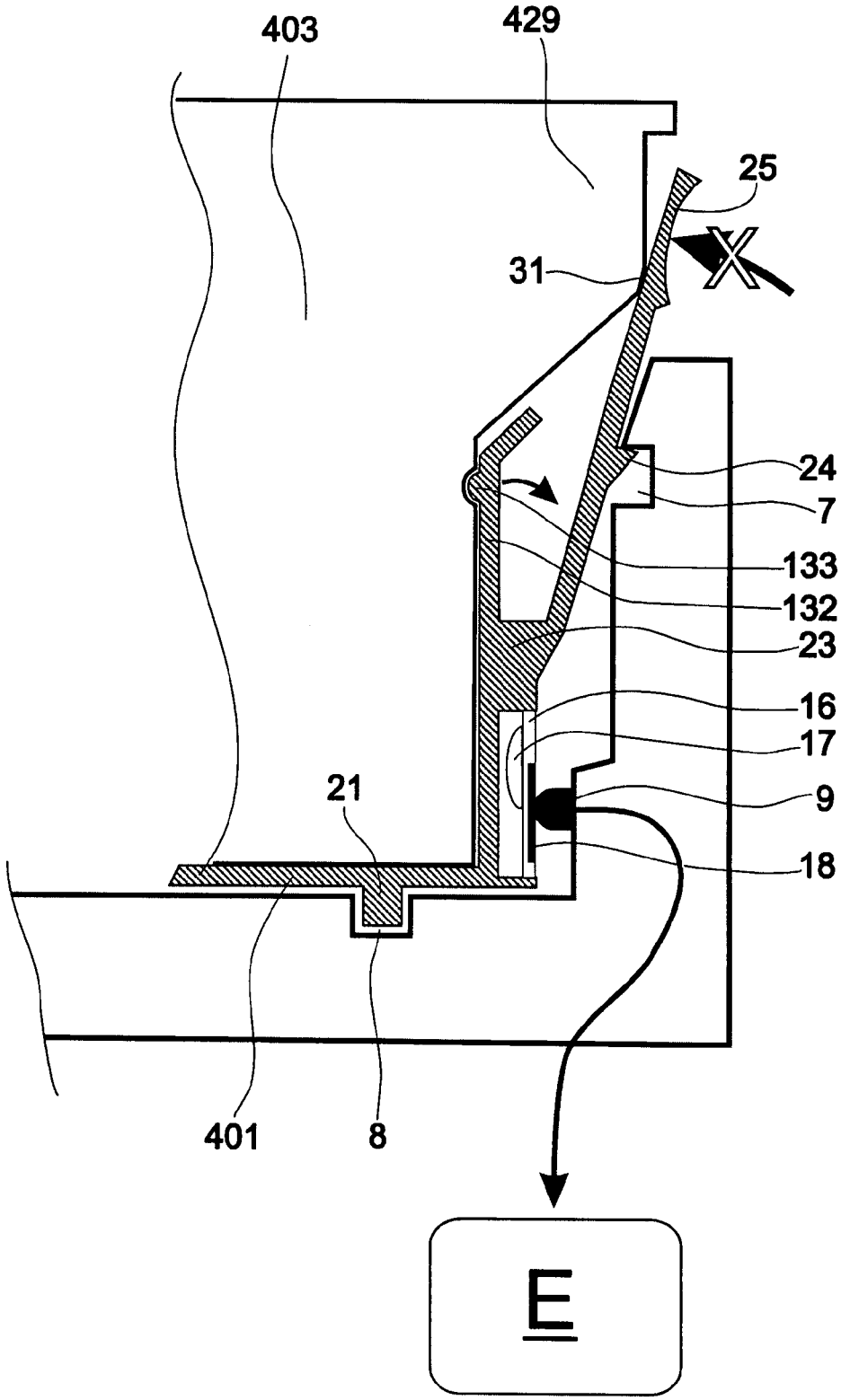
FIG. 12 shows the device as claimed in the invention in a fifth embodiment.

The circuit board 16 with the electronic circuit 17 and transducer 370 is shown in FIG. 11 enlarged a) from the side and b) frontally.

In the fifth version of an insert 401 the locking means as claimed in the invention is implemented in that the insert cartridge 403 has a lock projection 429 which analogously to the locking peg 29 in the preceding versions blocks the catch lever 23 with the insert cartridge 403 inserted in the fastening position.

Figure 13:
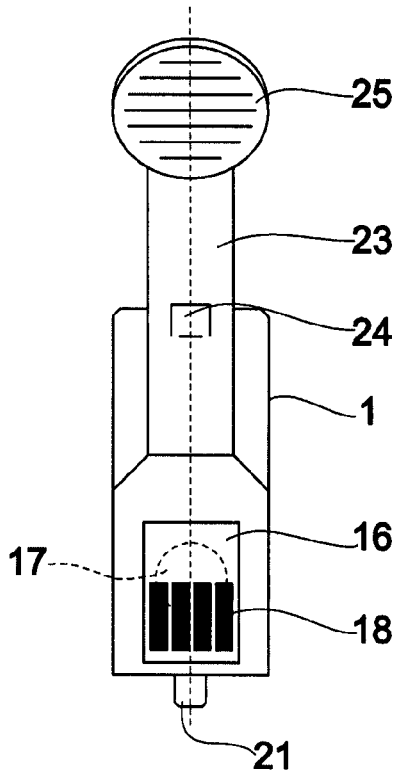
FIG. 13 shows the device as shown in FIG. 7, 8 or 10 in a front view.
Figure 14:
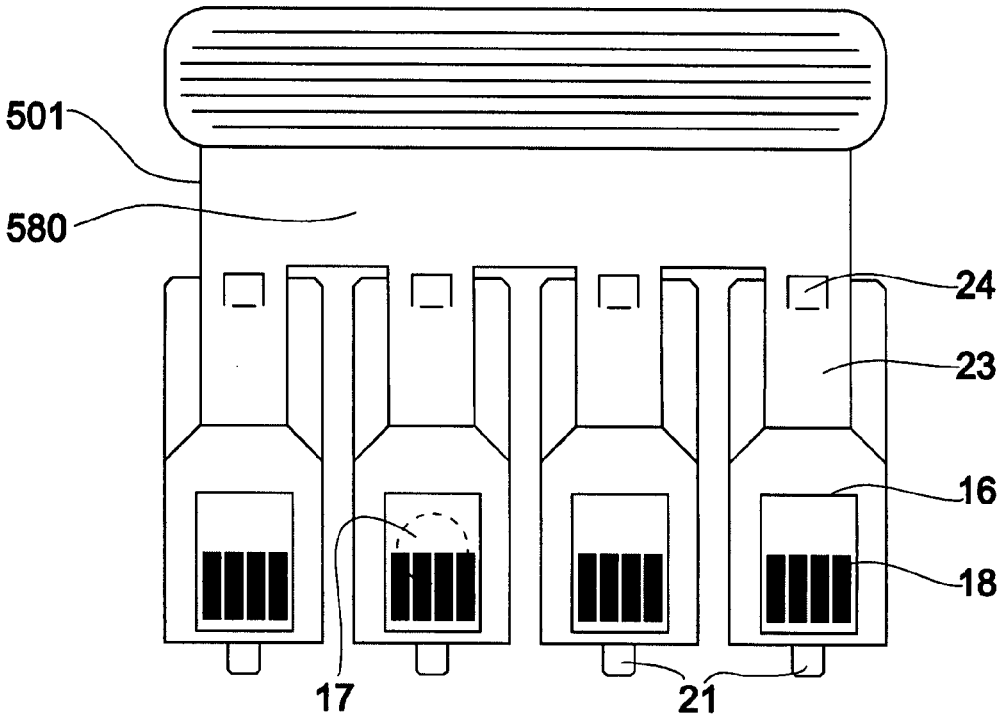
FIG. 14 shows a modified device as shown in FIG. 13.

FIG. 13 shows a view of an insert 1, 101, 201, 301, or 401 from the front side, i.e. relative to the representation in FIG. 1, 6, 8, 10 or 12 seen from the right. The same reference numbers are used here.

The insert 501 as shown in FIG. 13 is formed in principle from a plurality of individual inserts 1 (and the like) as in FIG. 13. They are mechanically interconnected via a common frame 580 so that simultaneous retrofitting of all cartridge receiving devices 2 of a multicolor printer is enabled, in the example for a four-color printer with yellow, magenta, cyan and black original ink cartridges (YMCK system). Each of the partial inserts 501 has a complete set of contact pads 18 which however are all connected to a single central semiconductor memory means or electronic circuit 17. This has the advantage that a printer can be especially easily and quickly completely retrofitted by the user for the purpose of the invention. Moreover an especially efficient semiconductor memory means or electronic circuit 17 can be used so that an especially efficient and economical structure is possible.

REFERENCE NUMBER LIST

1 insert
2 cartridge receiving device
3 insert ink cartridge (consumable insert cartridge)
4 original ink cartridge
5 ink connection
P inkjet printer (printer)
6 cartridge holder (notch/recess at right)
7 cartridge holder (notch/recess at left)
8 cartridge holder (notch/recess bottom)
9 first contact springs
E electronic circuit
10 ink outlet
11 fastening means (peg)
12 fastening means (projection)
13 catch lever
14 locking catch
15 grip
16 circuit board (board)
17 semiconductor memory means
18 contact pads (contact surfaces)
21 fastening means (peg)

22 fastening means (projection)
23 catch lever
24 locking catch
25 grip
26 through opening
27 locking opening
28 grip
29 locking peg
30 catch cam
31 support region
101 insert
103 insert cartridge
132 arm
133 catch projection
143 projection
144 depression
145 step
201 insert
203 insert cartridge
251 contact springs
252 electrical circuit
260 contact pads (contact surfaces)
261 electrical circuit
262 circuit board (board)
301 insert
303 insert cartridge
370 data transmission element (transducer)
371 receiver
401 insert
403 insert cartridge
501 insert
580 frame

What is claimed is:

1. A device for retrofitting a printer which has a cartridge receiving device for holding interchangeable consumable material cartridges, comprising an insert with a catch lever having a locking catch member for attachment in the cartridge receiving device of a printer, the catch lever being moveable between a lock position where the locking catch member is retained within a notch formed in the cartridge receiving device and a release position where the locking catch member is not engaging the notch on the insert the insert also includes a locking member which blocks movement of the catch lever from the lock position to the release position when a consumable material insert cartridge is connected in the cartridge receiving device.

2. The device as claimed in claim 1, wherein the insert includes stationary holding elements.

3. The device as claimed in claim 1, wherein the insert includes a stationary holding element for connection of a consumable material insert cartridge to the insert.

4. The device as claimed in claim 1, wherein the insert has joining means which can move relative to the insert for connection of a consumable material insert cartridge to the insert.

5. The device as claimed in claim 1, wherein the insert has electrical contact elements.

6. The device as claimed in claim 1, wherein the insert has data storage means.

7. The device as claimed in claim 1, wherein the insert comprises electronic circuits.

8. The device as claimed in claim 1, wherein the insert has contactless data transmission means.

9. The device as claimed in claim 1, wherein contactless data transmission elements are attached to the insert cartridge.

10. The device as claimed in claim 1, wherein the insert includes a second electrical contact elements for connection of with a consumable material insert cartridge.

11. The device as claimed in claim 1, wherein the insert has sensor elements.

12. The device as claimed in claim 1, wherein the insert has display means.

13. The device as claimed in claim 1, wherein the printer is an inkjet printing means and the consumable material cartridge is an ink cartridge.

14. A process for retrofitting a printer which has a cartridge receiving device for holding interchangeable consumable material cartridges, comprising the following process steps:

inserting and fastening an insert in the cartridge receiving device such that the insert is in a fastening position within the cartridge receiving device, connecting a consumable material insert cartridge, the insert being locked in the fastening position in the cartridge receiving device such that the insert may not be removed from the cartridge receiving device until the consumable material insert cartridge is disconnected from the insert.

15. The process as claimed in claim 14, wherein the connected consumable material cartridge is separated from the insert, the insert being unlocked from the fastening position in the cartridge receiving device.

16. A device for retrofitting a printer and a consumable material insert cartridge, wherein the device comprises an insert which has a locking catch for fastening in the cartridge receiving device of a printer, the locking catch being moveable between a lock position where the locking catch is retained within a notch formed in the cartridge receiving device and a release position where the locking catch is not engaging the notch on the insert, the insert also including a locking member which blocks movement of the locking catch from the lock position to the release position when the consumable material insert cartridge is connected.

17. The device as claimed in claim 16, wherein the insert further includes a catch lever which includes the locking catch.

18. The device as claimed in claim 17, wherein the catch lever is moveable between a lock position where the locking catch is retained within the notch formed in the cartridge receiving device and a release position where the locking catch is not engaging the notch on the insert.

19. The device as claimed in claim 18, wherein the locking member blocks movement of the catch lever from the lock position to the release position when the consumable material insert cartridge is connected.

* * * * *